US009700753B1

(12) United States Patent
Boatwright

(10) Patent No.: US 9,700,753 B1
(45) Date of Patent: Jul. 11, 2017

(54) PERSONAL FORCE RESISTANCE CABLE EXERCISE DEVICE, FORCE RESISTANCE ASSEMBLY, AND METHOD OF EXERCISING

(71) Applicant: Donald Jeffrey Boatwright, Charlotte, NC (US)

(72) Inventor: Donald Jeffrey Boatwright, Charlotte, NC (US)

( * ) Notice: Subject to any disclaimer, the term of this patent is extended or adjusted under 35 U.S.C. 154(b) by 104 days.

(21) Appl. No.: 14/639,402

(22) Filed: Mar. 5, 2015

Related U.S. Application Data

(63) Continuation-in-part of application No. 14/502,068, filed on Sep. 30, 2014, which is a continuation of
(Continued)

(51) Int. Cl.
*A63B 21/015* (2006.01)
*A63B 21/00* (2006.01)
*A63B 24/00* (2006.01)

(52) U.S. Cl.
CPC ..... *A63B 21/153* (2013.01); *A63B 21/015* (2013.01); *A63B 21/4035* (2015.10);
(Continued)

(58) Field of Classification Search
CPC ... A63B 21/023; A63B 21/152; A63B 21/015; A63B 23/0405; A63B 23/0411; A63B 24/0062; A63B 21/153; A63B 21/4045; A63B 21/4035; A63B 24/0087; A63B 21/0557; A63B 21/22; A63B 21/225; A63B 2023/0411; A63B 21/151; A63B 21/00192; A63B 21/005; A63B 21/0051; A63B 21/0052; A63B 21/0056; A63B 21/08; A63B 21/076; A63B 21/0076;
(Continued)

(56) References Cited

U.S. PATENT DOCUMENTS 141,967 A 8/1873 Van Houten
3,640,530 A * 2/1972 Henson ..... A63B 21/153 482/116

(Continued)

OTHER PUBLICATIONS

Boca Bearings; website: https://web.archive.org/web/20101115013115/http://www.bocabearings.com/bearing-types/one-way-bearings Archived: Nov. 15, 2010 Retrieved: Jan. 5, 2016.*

(Continued)

*Primary Examiner* — Loan H Tranh
*Assistant Examiner* — Megan Anderson
(74) *Attorney, Agent, or Firm* — Schwartz Law Firm, P.C.

(57) ABSTRACT

A cable exercise device incorporating a force resistance assembly, an elongated flexible cable, and a moveable exercise implement. The force resistance assembly comprises a mounting frame, a rotatable axle operatively supported by the mounting frame, a cable spool carried by the axle, and a magnetic braking device operatively connected to the cable spool. The magnetic braking device comprises an eddy current braking system incorporating a flywheel and magnet. The flexible cable is attached to the force resistance assembly, and is adapted for winding on and unwinding from the cable spool. The movable exercise implement is secured to the flexible cable, and is adapted for being employed by a user performing an exercise.

18 Claims, 7 Drawing Sheets

Related U.S. Application Data application No. 13/315,847, filed on Dec. 9, 2011, now Pat. No. 8,845,499.

(52) U.S. Cl.
CPC ..... *A63B 21/4045* (2015.10); *A63B 24/0062* (2013.01); *A63B 24/0087* (2013.01)

(58) Field of Classification Search
CPC ..... A63B 69/06; A63B 2069/062; A63B 2069/064; A63B 2069/066; A63B 2069/068
See application file for complete search history.

(56) References Cited

U.S. PATENT DOCUMENTS

| | | | | | |
|---|---|---|---|---|---|
| 3,785,644 | A | | 1/1974 | Bradley et al. | |
| 3,929,331 | A | * | 12/1975 | Beeding | A63B 21/015 482/116 |
| 3,995,853 | A | * | 12/1976 | Deluty | A63B 21/015 482/116 |
| 4,090,694 | A | * | 5/1978 | Vincent | E01F 15/0438 256/13.1 |
| 4,138,106 | A | * | 2/1979 | Bradley | A63B 21/0058 482/116 |
| 4,235,439 | A | * | 11/1980 | De Donno | A63B 21/015 188/75 |
| 4,479,647 | A | * | 10/1984 | Smith | A63B 21/0058 482/4 |
| 5,031,900 | A | | 7/1991 | Leask | |
| 5,139,469 | A | | 8/1992 | Hennessey et al. | |
| 5,154,684 | A | * | 10/1992 | Delf | A63B 21/015 482/116 |
| 5,400,875 | A | | 3/1995 | Anthony et al. | |
| 5,433,299 | A | | 7/1995 | Sundstrom et al. | |
| 5,586,624 | A | | 12/1996 | Ko et al. | |
| 5,992,618 | A | | 11/1999 | Joh | |
| 6,030,321 | A | | 2/2000 | Fuentes | |
| 6,315,701 | B1 | | 11/2001 | Shifferaw | |
| 6,450,922 | B1 | | 9/2002 | Henderson et al. | |
| 6,569,065 | B1 | | 5/2003 | Menold et al. | |
| 6,659,922 | B1 | | 12/2003 | Yu | |
| 6,726,607 | B1 | | 4/2004 | Ihli | |
| 6,749,050 | B2 | | 6/2004 | Ouchi | |
| 6,770,014 | B2 | | 8/2004 | Amore | |
| 7,087,001 | B1 | | 8/2006 | Ihli | |
| 7,094,184 | B1 | | 8/2006 | Chen et al. | |
| 7,506,697 | B2 | | 3/2009 | Pflieger | |
| 7,909,745 | B2 | | 3/2011 | Mills et al. | |
| 8,585,561 | B2 | | 11/2013 | Watt et al. | |
| 2003/0087735 | A1 | | 5/2003 | Chen | |
| 2004/0102292 | A1 | | 5/2004 | Pyles et al. | |
| 2004/0204293 | A1 | | 10/2004 | Andreasen | |
| 2007/0284209 | A1 | | 12/2007 | Chen | |
| 2008/0096725 | A1 | | 4/2008 | Keiser | |
| 2010/0144496 | A1 | | 6/2010 | Schmidt | |
| 2014/0274600 | A1 | * | 9/2014 | Dalebout | A63B 21/225 482/115 |
| 2015/0011368 | A1 | * | 1/2015 | Manor | A63B 21/0051 482/116 |

OTHER PUBLICATIONS

Kettler USA Coach Rowers w/over 16 Different Exercies; Kettler USA; http://www.kettlerusa.com/blog/?p=293; published prior to Mar. 5, 2015.

* cited by examiner

PERSONAL FORCE RESISTANCE CABLE EXERCISE DEVICE, FORCE RESISTANCE ASSEMBLY, AND METHOD OF EXERCISING

TECHNICAL FIELD AND BACKGROUND OF THE INVENTION

This invention relates broadly and generally to a personal force resistance cable exercise device, force resistance assembly, and method of exercising. In exemplary embodiments discussed herein, the present exercise device is generally light weight, compact in size, and portable, can be conveniently stored under a bed or in a closet, and can be readily transported anywhere by anyone. Exemplary embodiments of the present invention may combine various structural features and elements described in Applicant's prior issued U.S. Pat. No. 8,845,499. The complete disclosure of this prior patent is incorporated herein by reference.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a cable exercise device incorporating a force resistance assembly, elongated flexible cable, and movable exercise implement. The force resistance assembly includes a mounting frame, a rotatable axle supported by the mounting frame, a one-way cable spool carried by the axle, and a magnetic braking device operatively connected to the cable spool. The one-way cable spool locks to the axle upon rotation of the cable spool in a working force-resistance direction, and is freely movable relative to the axle upon rotation of cable spool in an opposite cable-wind-up direction. The flexible cable is attached to the force resistance assembly, and is adapted for winding on and unwinding from the cable spool. The exercise implement is secured to the flexible cable, and is adapted for being employed by a user performing an exercise.

The term "one-way cable spool" refers broadly herein to any rotatable unit which is allowed to substantially free-wheel in one direction on a shaft, but when a torque is applied in the opposite direction, the unit locks, binds, or wedges onto the shaft because of changes in bearing alignment and friction. In the present exemplary embodiment, the cable spool operates in "one-way" by locking onto the axle when rotated in the working or force-resistance direction, but slips over the axle when counter-rotated in the cable-wind-up direction.

The term "exercise implement" refers broadly to any movable structure designed for being pushed, pulled, pressed, curled, raised, lifted, or otherwise moved by a user against the force of the resistance assembly in one or more exercise repetitions utilizing the exemplary exercise device.

According to another exemplary embodiment, the magnetic braking device comprises an eddy current braking system incorporating a flywheel and at least one magnet (e.g., electromagnet). Examples of eddy current braking systems are provided in prior U.S. Pat. Nos. 7,094,184, 6,450,922, and 5,031,900. The complete disclosure of these prior patents is incorporated herein by reference. In alternative embodiments, the magnetic braking device comprises a hysteresis braking system, or a combination of eddy current and hysteresis braking systems. Alternatively, or in addition, the present braking system may incorporate one or more permanent and/or electromagnets in a similar manner described in prior U.S. Pat. No. 8,585,561. According to the resistance system of the '561 patent, the magnets are moved (shifted) relative to the flywheel to increase and reduce the drag or braking force on the flywheel. The complete disclosure of the '561 patent is also incorporated by reference herein.

According to another exemplary embodiment, the force resistance assembly further comprises a pulley fixed to the axle and a (friction) drive belt. The drive belt operatively interconnects the pulley and the flywheel of the eddy current braking system.

According to another exemplary embodiment, an electronic operator console communicates (via cable or wirelessly) with the eddy current braking system, and is adapted for supplying an electric current to the electromagnet.

According to another exemplary embodiment, the operator console comprises an operator button for selecting one of a plurality of different current levels (e.g., 40 or more) to supply to the electromagnet.

According to another exemplary embodiment, a cable rewind spring is operatively attached to the one-way cable spool, and is adapted for normally urging rotation of the cable spool in the cable-wind-up direction. Alternatively, the cable spool may be counter rotated in the cable-wind-up direction via DC motor, or other electro-mechanical or mechanical means.

According to another exemplary embodiment, the one-way cable spool comprises a one-way needle bearing adapted for operatively engaging the axle upon rotation of the cable spool in the working force-resistance direction. The needle bearing may be integrally formed with the cable spool, or separately formed and permanently attached (e.g., by press-fit, welding or other means). In alternative arrangements, a sprag clutch or other means may be employed to effect one-way operation of the cable spool.

According to another exemplary embodiment, the exercise implement comprises an elongated hollow metal bar having a cable-entry end and an opposing cable-exit end, and first and second cable bearings located at respective cable-entry and cable-exit ends. The term "cable bearing" refers broadly herein to any device (such as a rotatable pulley or plain bearing) that supports, guides, and reduces the friction of motion between the cable and exercise implement.

According to another exemplary embodiment, a standing platform is located adjacent to the force resistance assembly.

According to another exemplary embodiment, means are provided for releasably attaching the free end of the flexible cable to the standing platform.

According to another exemplary embodiment, the means for releasably attaching the flexible cable comprises a metal carabiner.

According to another exemplary embodiment, an electronic scale is formed with or located adjacent the standing platform for measuring a force exerted by the user when performing the exercise.

In another exemplary embodiment, the present disclosure comprises a cable exercise device incorporating a force resistance assembly, an elongated flexible cable, and a moveable exercise implement. The force resistance assembly comprises a mounting frame, a rotatable axle operatively supported by the mounting frame, a cable spool carried by the axle, and a magnetic braking device operatively connected to the cable spool. The magnetic braking device comprises an eddy current braking system incorporating a flywheel and electromagnet. The flexible cable is attached to the force resistance assembly, and is adapted for winding on and unwinding from the cable spool. The movable exercise implement is secured to the flexible cable, and is adapted for being employed by a user performing an exercise.

In yet another exemplary embodiment, the present disclosure comprises a method for exercising. The method includes exerting a force (directly or indirectly) against an exercise implement attached (directly or indirectly) to an elongated flexible cable. The flexible cable is attached to a force resistance assembly comprising a mounting frame, a rotatable axle supported by the mounting frame, a one-way cable spool carried on the axle, and a magnetic braking device. The one-way cable spool is locked to the axle upon rotation of the cable spool in a working force-resistance direction, and is freely movable relative to the axle upon rotation of cable spool in an opposite cable-wind-up direction.

BRIEF DESCRIPTION OF THE DRAWINGS

Exemplary embodiments of the present invention will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
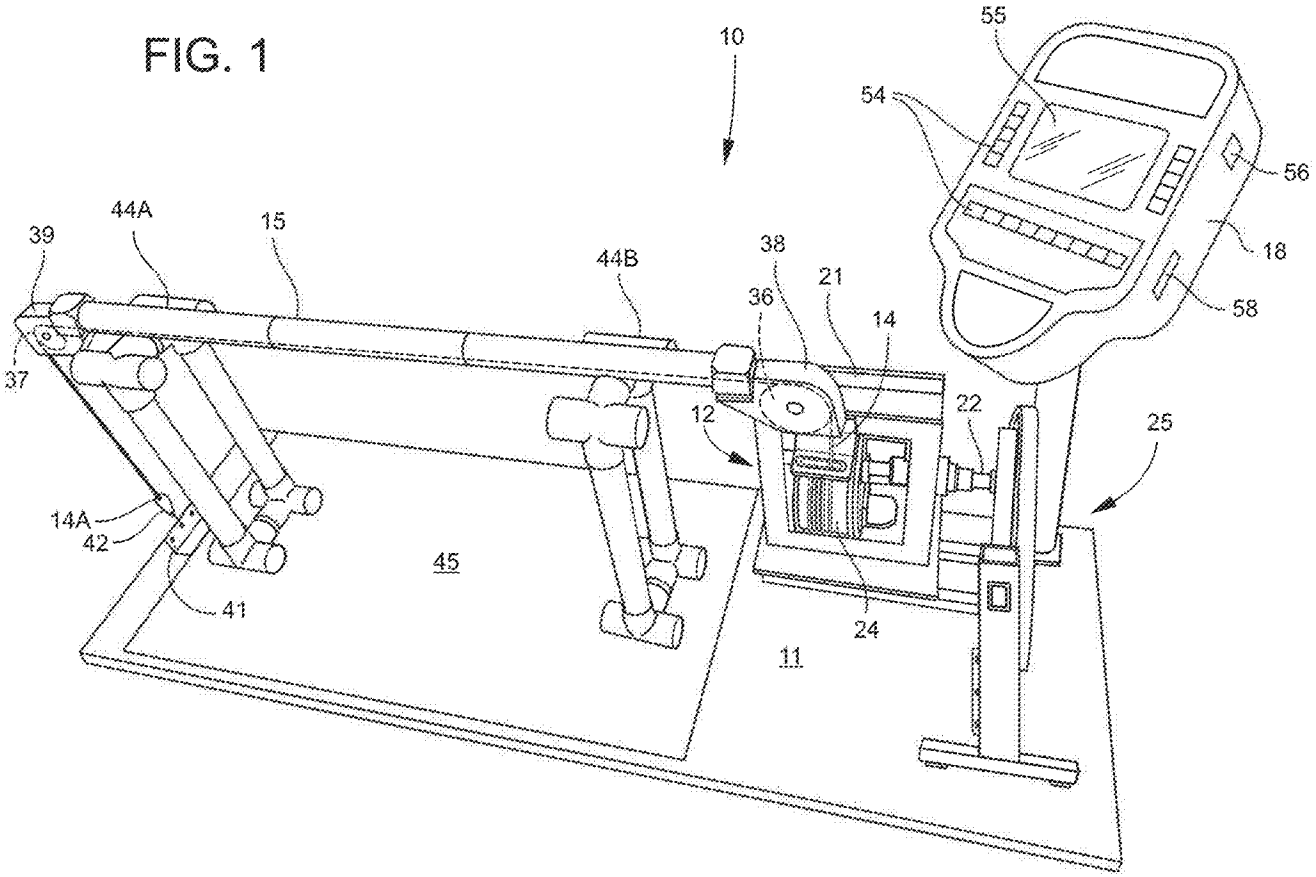
FIG. 1 is a perspective view of a personal force-resistance exercise device according to one exemplary embodiment of the present disclosure.

Referring now specifically to the drawings, a personal force-resistance cable exercise device according to one exemplary embodiment of the present disclosure is illustrated in FIG. 1, and shown generally at broad reference numeral 10. The exemplary exercise device 10 comprises a flat standing platform 11, a compact force resistance assembly 12 mounted on or adjacent the platform 11, a flexible steel cable 14 attached to the force resistance assembly 12, an elongated double-pulley exercise bar 15 secured to the cable 14, and an electronic programmable operator console 18. The exemplary force resistance assembly 12 comprises a rigid mounting frame 21, a rotatable steel axle 22 supported by bearings within the frame 21, a one-way cable spool 24 carried on the axle 22, and an adjustable magnetic braking device 25 operatively connected (via axle 22) to the cable spool 24.

Figure 2:
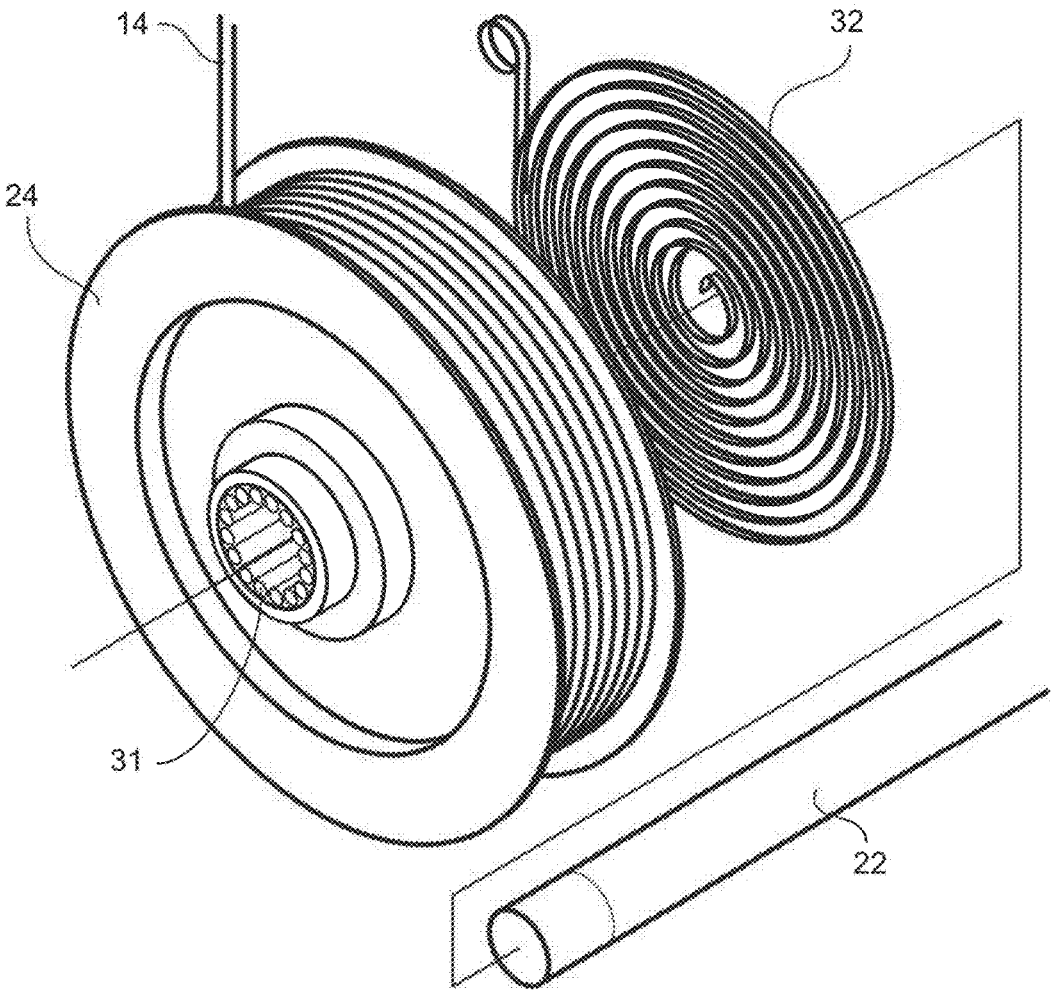
FIG. 2 is an exploded view illustrating various parts of the exemplary cable spool.

As best shown in FIG. 2, the exemplary one-way cable spool 24 comprises an integrally (or separately) formed one-way needle bearing 31 which locks to the steel axle 22 upon rotation of the cable spool 24 in a working force-resistance direction, and which releases from the axle 22 upon counter-rotation of the cable spool 24 in an opposite cable-wind-up direction. The flexible cable 14 is attached to the force resistance assembly 12 (e.g., at cable spool 24), and is adapted for winding on and unwinding from the cable spool 24 during use of the exercise device 10, as discussed below. The exemplary cable spool 24 may have circumferential surface grooves which serve to substantially limit overlap of the cable 14 when winding on the spool 24. A spiral torsion spring 32 or other biasing means is attached at one end to the mounting frame 21 and at its other end to the cable spool 24, and functions to normally urge counter-rotation of the cable spool 24 in the cable-wind-up direction.

Figure 3:
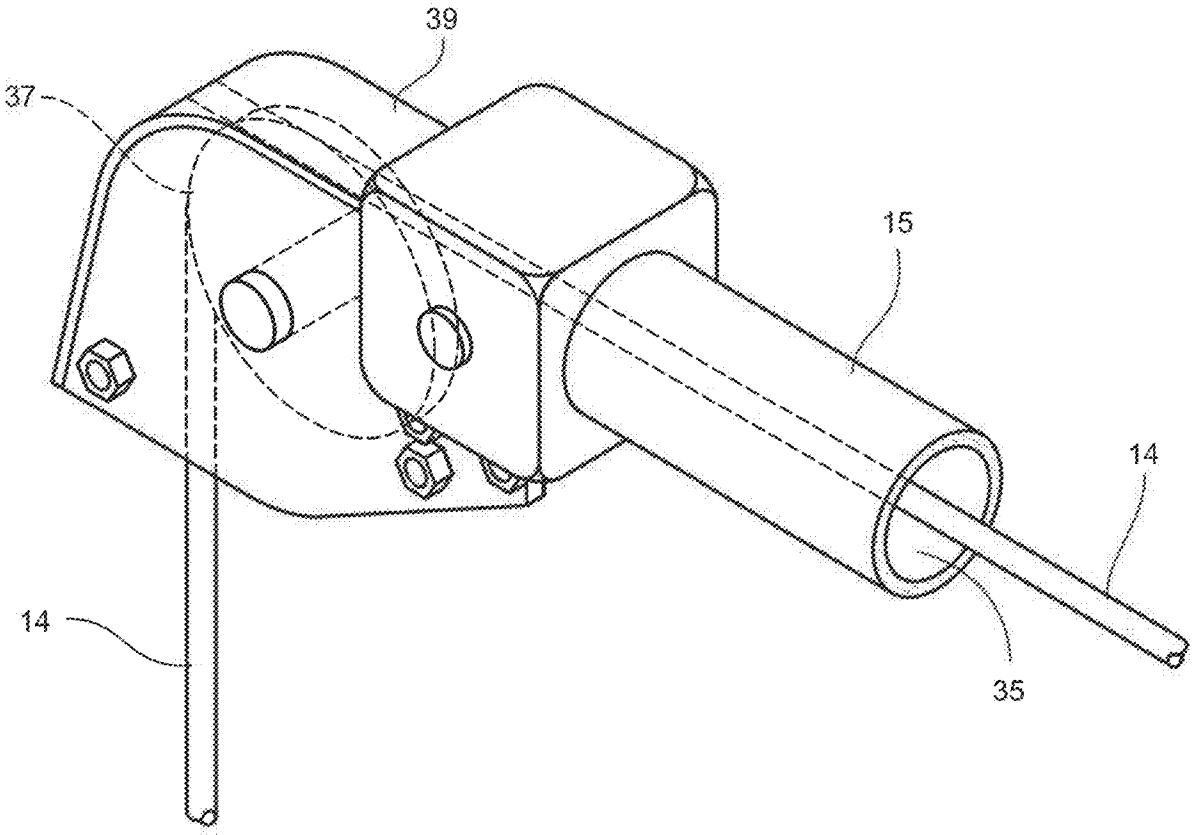
FIG. 3 is a fragmentary view of the exemplary exercise bar showing the end bracket and cable bearing (e.g., pulley), and the flexible cable passing through the exercise bar towards the standing platform.

Referring to FIGS. 1 and 3, the exemplary exercise bar 15 is slidably secured to the flexible cable 14, such that the exercise bar 15 can be manually lifted relative to the standing platform 11 with substantially smooth uniform resistance as the cable 14 lengthens from the spool 24. In the present embodiment, the exercise bar 15 comprises an elongated rigid hollow member 35 with respective cable pulleys 36, 37 (or bearings) located at opposite open ends. The cable pulleys 36, 37 are attached via brackets 38, 39. A looped free end 14A of the flexible cable 14 is passed into a first open end of the exercise bar 15 over cable pulley 36, extends through hollow member 35, and outwardly through the second open end over cable pulley 37 towards the standing platform 11. The cable free end 14A is releasably anchored to a fixed platform bracket 41 using a metal carabiner 42 or other suitable fastener. In a ready position shown in FIG. 1, the exercise bar 15 sits on an adjustably elevated bar rack 44A, 44B in a substantially zero resistance condition—tensioned only by the wind-up force of the torsion spring 32. An ultra-slim weigh pad 45 may be integrally formed with or adjacent the standing platform 11, and may operatively connect (e.g., wirelessly or via cable) to the electronic operator console 18 to communicate a measured real time force exerted by the user when performing an exercise.

Electronic Operator Console 18

Figure 4:
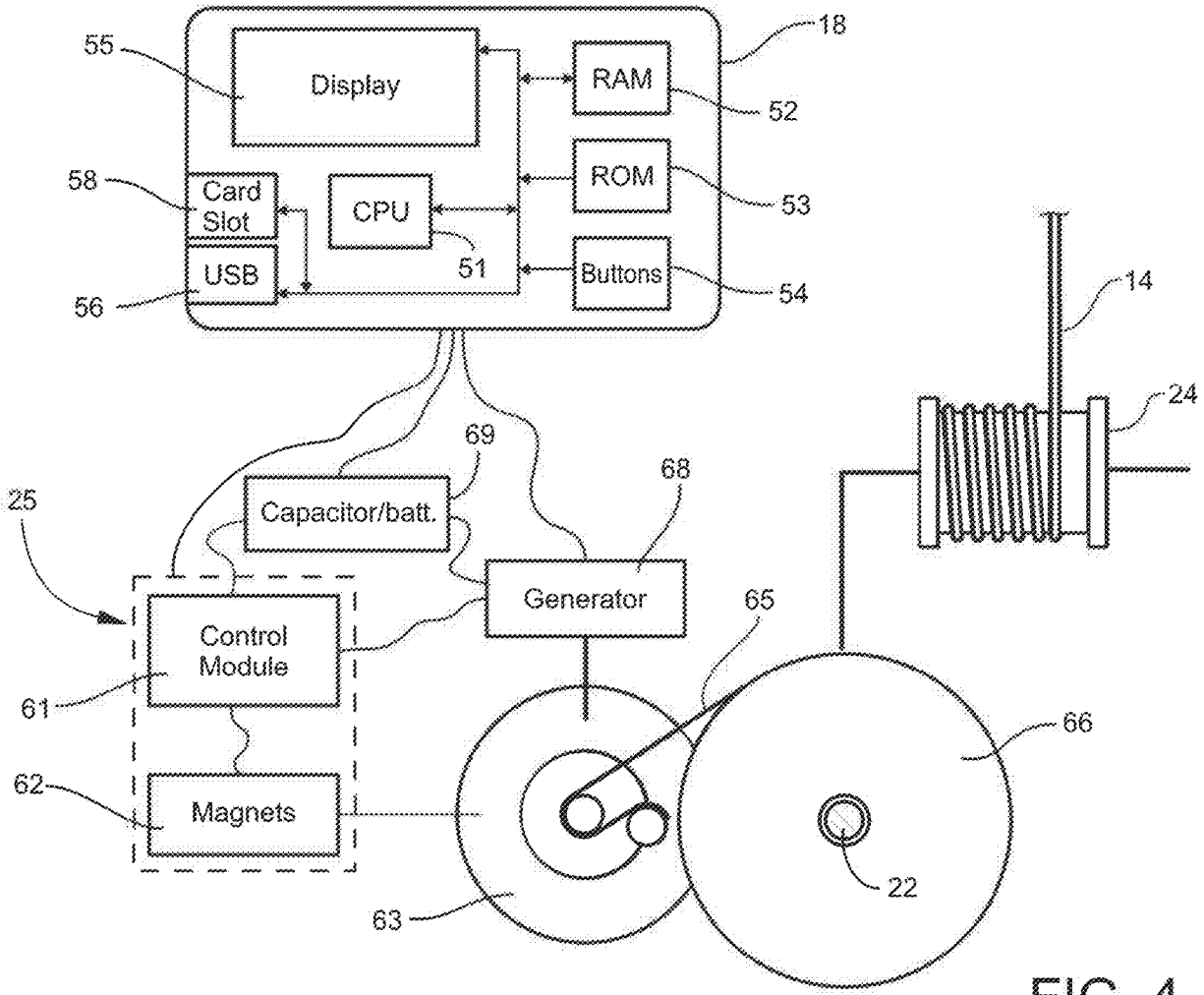
FIG. 4 is a schematic view illustrating various features of the operator console and exemplary force resistance assembly.

Referring to FIGS. 1 and 4, the exemplary programmable operator console 18 comprises a microcontroller CPU 51, RAM 52 for storing temporary information for workouts, exercises, and strength tests, ROM 53 for storing permanent program and user information, operator buttons 54 for navigating through menus and selecting options, a port for connecting (e.g., via cable) to the magnetic braking device 25, an LCD display 55 for displaying program and exercise information to the user, a USB port 56 for connecting via USB cable to external computing devices (including, e.g., smartphones, tablet computers, laptop computers, and the like) for downloading exercise routines and software upgrades, and a memory card slot/reader 58 for accepting an external memory card. The operator buttons 54 allow the user to negotiate forward and backwards through menus, and up and down through menu selections, in a conventional manner. Enter button selects options, undo button undoes selections, start/pause button starts or pauses console operation, and power button turns operator console on and off. In the present device 10, the operator buttons 54 enable a user to select between 1-40 different levels of force resistance generated by operation of the magnetic braking device 25, discussed below.

Magnetic Braking Device 25

Figure 5:
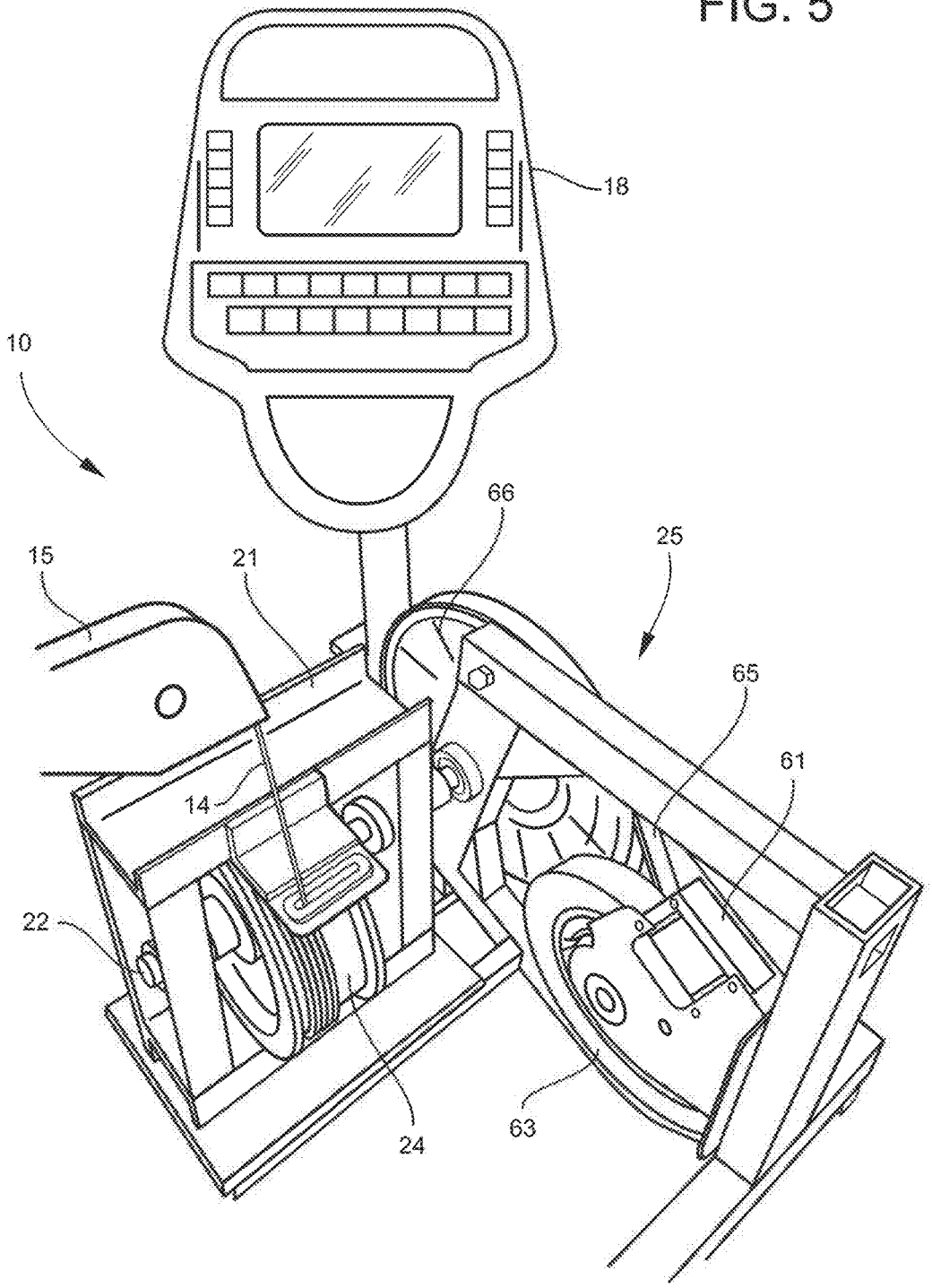
FIG. 5 is a fragmentary perspective view showing a portion of the exemplary exercise device.
Figure 6:
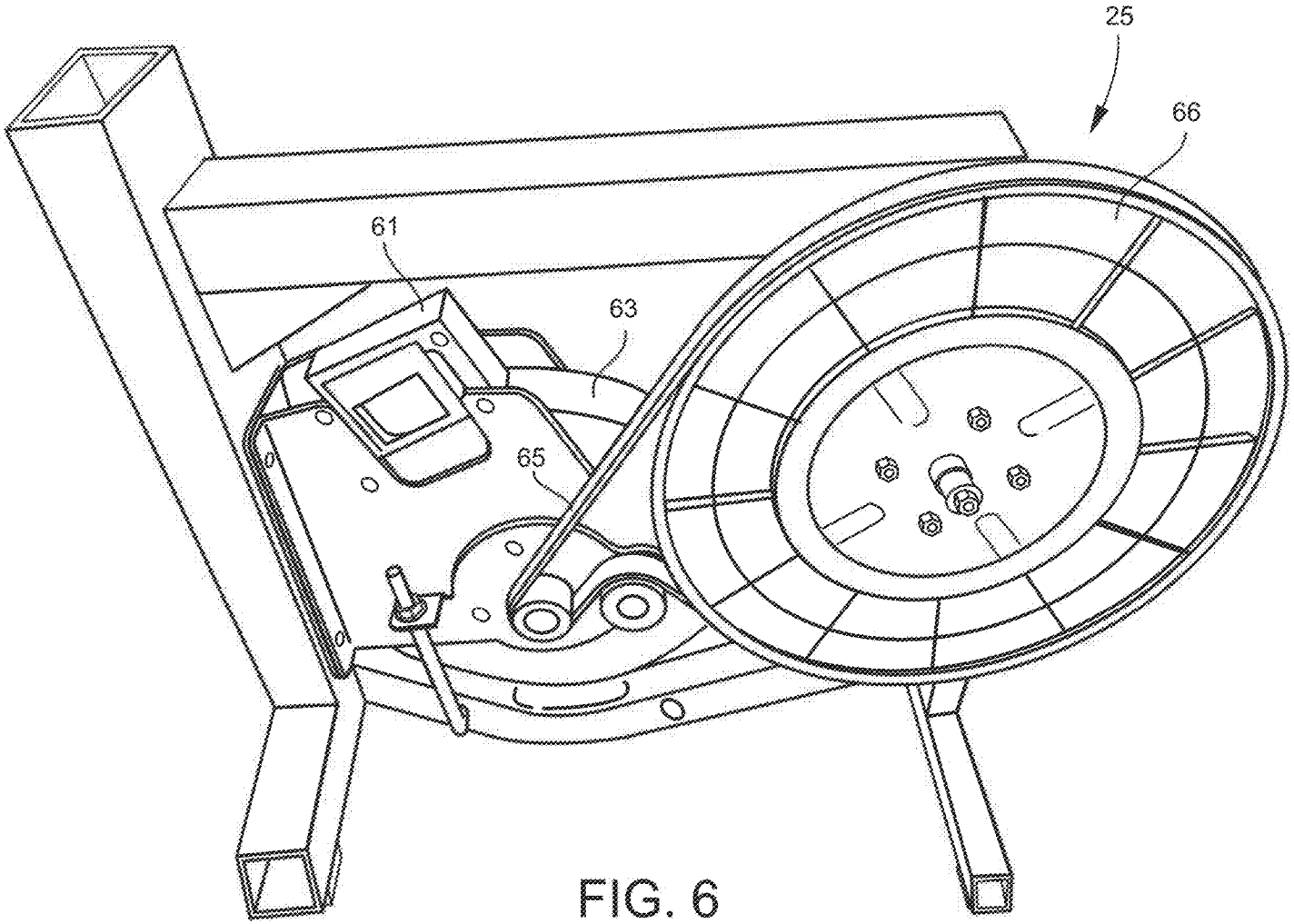
FIG. 6 is a fragmentary perspective view showing a further portion of the exemplary exercise device.

Referring to FIGS. 4, 5, and 6, the exemplary braking device 25 comprises an electromagnetic control module 61 operatively connected to the operator console 18 (e.g., via cable), and to one or more magnets 62 mounted adjacent a peripheral margin of a rotatable non-ferromagnetic metal flywheel 63. The magnets 62 may comprise permanent magnets, electromagnets, or a combination of electromagnets and permanent magnets. In one exemplary embodiment, the braking device 25 utilizes an eddy current braking (ECB) system. As best shown in FIG. 6, the metal flywheel 63 is connected through a friction (e.g., rubber) drive belt 65 to a rotatable pulley 66 affixed to the axle 22, such that one-way rotation of the cable spool 24 when performing an exercise causes the pulley 66 to spin thereby spinning the belt-attached flywheel 63 and activating the ECB system.

In the present ECB system, the flywheel 63 acts as a conductor to support induced eddy currents. As the flywheel 63 moves through graduated magnetic fields produced by the magnets 62, the induced eddy currents interact with the magnetic fields to provide a retarding or breaking function on the flywheel 63, which transfers directly to the belt-attached pulley 66 to the cable spool 24. The drag force in the ECB system is controlled by the amount of current passed through the electromagnet windings—the greater the current, the greater the braking force acting on the cable spool 24. The current level (1-40) is selected by the user via operator console 18. Maximum force resistance (or drag) is generated at level 40. Generator 68 connects to the flywheel 63 and supplies power to the electronic operator console 18 and braking device 25 during operation of the exercise device 10.

Because the braking force of the ECB system is dependant upon rotational velocity of the flywheel 63, the ECB system alone has no holding force when the flywheel 63 is stationary. To account for this, the exemplary exercise device 10 includes a hysteresis magnetic brake and/or adjustable position magnets capable of immediate braking even after the flywheel 63 has stopped rotating. The ECB system and the hysteresis system typically are accompanied by additional permanent and/or electromagnets which are adjustable in position with respect to the flywheel (see, e.g., U.S. Pat. No. 8,585,561) to add resistance during non-rotation and during rotation. Persistent short term power to the operator console 18 and braking magnets 62 may be supplied by a capacitor or rechargeable batteries 69. This short-term power supply 69 maintains temporary activation of the operator console 18 when the flywheel 63 is stopped, and enables a pre-selected level of current flow to the hysteresis magnet and/or specific magnet position control, thereby setting and maintaining an immediate desired level of exercise resistance. For example, assume the resistance level is set by the user at level 20 (via operator console) for a particular exercise. After performing an exercise set, the user may return the exercise bar 15 to the bar rack 44A, 44B and rest for 1-3 minutes before beginning a subsequent set. During this rest period, rotation of the flywheel 63 and therefore operation of the ECB system may cease. Unless the resistance level is reset by the user via operator console 18, when the user resumes exercising the persistent power supply 69 will maintain a level 20 resistance immediately as the exercise bar 15 is lifted from the rack 44A, 44B and before full rotation of the flywheel 63. As the flywheel 63 reaches a threshold speed, the generator 68 begins supplying operating current to the exercise device 10, while the operator console 18 automatically decreases current flow to the hysteresis brake and/or changes position of the magnets, it increases current to the ECB system as required by the preselected resistance level. In alternative embodiments, longer term persistent power supply may be achieved by connecting the exercise device 10 to a 120-volt AC power source.

Alternatively, or in addition to the braking system described above, the present exercise device 10 may employ other resistance means, including controllable fluid resistance elements, electromagnetic motors, magnetic particle brakes, and magnetic fluid resistance elements. The exemplary braking device 25 can utilize a combination of hysteresis brakes and eddy current brakes, as previously described, or hysteresis braking only, or eddy current braking only.

Exemplary Exercises

Figure 7:
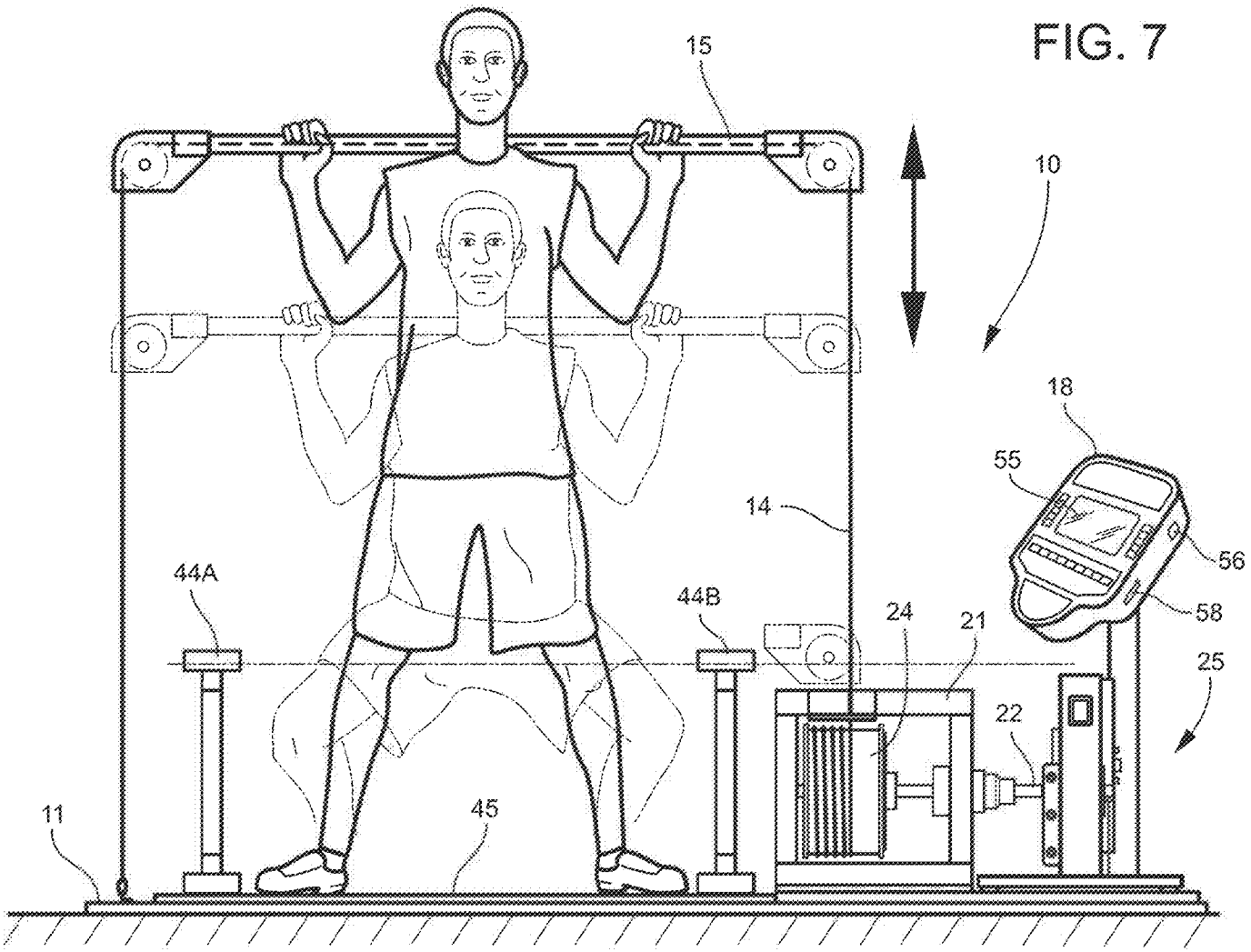
FIG. 7 is a view demonstrating use of the exercise device by a user performing a strength training exercise.

FIG. 7 demonstrates use of the exemplary exercise device 10 to perform full body squats. In a deep squatted position, the user places the exercise bar 15 behind the neck as shown. As the user begins to raise upwardly, the exercise bar 15 pulls the cable 14 from the one-way cable spool 24. The cable spool 24 rotates in the working direction to lengthen the cable 14 as the needle bearing 31 frictionally locks (or clamps) onto the steel axle 22. Continued upward movement of the exercise bar 15 causes simultaneous rotation of the cable spool 24, axle 22, and pulley 66. Rotation of the pulley 66 causes the belt-attached flywheel 63 to spin. Once the flywheel 63 is spinning, the user force required to lengthen the cable 14 and thereby lift the exercise bar 15 is largely dictated by the ECB system of the magnetic braking device 25, as previously described, and the selected level of force resistance. Substantially smooth, uniform, constant resistance is applied throughout the entire range of movement of the exercise bar 15 as the user moves from the initial deep squatted position to a full standing position.

Moving from the full standing position back to the squatted position, torsion spring 32 causes the cable spool 24 to counter-rotate thereby unlocking the needle bearing 31 on the axle 22 and allowing the flexible cable 14 to retract and rewind within respective grooves of cable spool 24 as the exercise bar 15 is lowered back towards the standing platform 11. The released cable spool 24 counter-rotates in the cable-wind-up direction independent of the axle 22 and pulley 66 (which both continue rotating in the opposite direction). The exemplary operator console 18 records each exercise and repetition of the user, and may incorporate a digital camera (not shown) for capturing video of the user while exercising for subsequent playback via the LCD display 55. The user video may be stored on an external memory card, or transferred from the operator console 18 via USB connection to any other independent computing device, thereby allowing subsequent analysis and critiquing of each workout over any given period of time. The magnetic braking device 25 creates a specific resistance force as set by the user on the operator console 18 for a maximum speed of unwinding the cable 14. As the user's muscles fatigue during the exercise, a slower unwind speed is allowed with less resistance allowing a more effective exercise.

In addition to squats, the present exercise bar 15 may be used for other strength training exercises including, for example, military shoulder press, bench press, arm curls, arm extensions, bent-over rows, lat pulls, rowing exercises, and others. In alternative implementations, a shorter bar (not shown) may be attached to the free end of the flexible cable (e.g., via carabiner), and used for exercises such as arm curls, arm extensions, and others. Other exercise bars and implements, such as angled bars, triangles, ropes, one-hand handles, and the like may also be used with the present device. The present exemplary exercise device may provide resistance forces from 5 to 500 pounds, and could easily be adapted to provide more or less depending on the specific requirement. Additionally, the exemplary exercise device may be used in combination with other strength training machines and implements, such as elastic bands, free weights, and others.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A cable exercise device, comprising:

a force resistance assembly including a mounting frame, a rotatable axle operatively supported by said mounting frame, a one-way cable spool carried by said axle, a magnetic braking device operatively connected to said cable spool and comprising a flywheel and at least one magnet, a pulley fixed to said axle, and a drive belt operatively interconnecting said pulley and said flywheel, and said one-way cable spool being locked to said axle upon rotation of said cable spool in a working force-resistance direction, and freely movable relative to said axle upon rotation of cable spool in an opposite cable-wind-up direction;

an elongated flexible cable attached to said force resistance assembly, and adapted for winding on and unwinding from said cable spool; and a movable exercise implement secured to said flexible cable, and adapted for being employed by a user performing an exercise.

2. The cable exercise device according to claim 1, and comprising a standing platform located adjacent to said force resistance assembly.

3. The cable exercise device according to claim 2, and comprising means for releasably attaching the free end of said flexible cable to said standing platform.

4. The cable exercise device according to claim 2, and comprising an electronic scale adjacent said standing platform adapted for measuring a force exerted by the user when performing the exercise.

5. The cable exercise device according to claim 1, and comprising an electronic operator console communicating with said braking device and adapted for supplying an electric current to said magnet.

6. The cable exercise device according to claim 5, wherein said operator console comprises an operator button for selecting one of a plurality of different current levels to supply to said magnet.

7. The cable exercise device according to claim 1, and comprising a cable rewind spring operatively attached to said one-way cable spool, and adapted for normally urging rotation of said cable spool in the cable-wind-up direction.

8. The cable exercise device according to claim 7, wherein said one-way cable spool comprises a one-way needle bearing adapted for operatively engaging said axle upon rotation of said cable spool in the working force-resistance direction.

9. The cable exercise device according to claim 1, wherein said braking device comprises a system selected from a group consisting of an eddy current braking system, a hysteresis braking system, and a combination of eddy current and hysteresis braking systems.

10. The cable exercise device according to claim 1, wherein said exercise implement comprises an elongated hollow bar having a cable-entry end and an opposing cable-exit end, and first and second bearings located at respective cable-entry and cable-exit ends.

11. A cable exercise device, comprising:

a force resistance assembly comprising a mounting frame, a rotatable axle operatively supported by said mounting frame, a cable spool carried by said axle, a magnetic braking device operatively connected to said cable spool and comprising a flywheel and at least one magnet, a generator operatively connected to said flywheel, and a system selected from a group consisting of an eddy current braking system, a hysteresis braking system, and a combination of eddy current and hysteresis braking systems;

an elongated flexible cable attached to said force resistance assembly, and adapted for winding on and unwinding from said cable spool; and a movable exercise implement secured to said flexible cable, and adapted for being employed by a user performing an exercise.

12. The cable exercise device according to claim 11, and comprising an electronic operator console communicating with said braking device and adapted for supplying an electric current to said magnet.

13. The cable exercise device according to claim 12, wherein said operator console comprises an operator button for selecting one of a plurality of different current levels to supply to said magnet.

14. The cable exercise device according to claim 11, wherein said force resistance assembly further comprises a pulley fixed to said axle, and a drive belt operatively interconnecting said pulley and the flywheel of said braking device.

15. The cable exercise device according to claim 11, wherein said exercise implement comprises an elongated hollow bar having a cable-entry end and an opposing cable-exit end, and first and second cable bearings located at respective cable-entry and cable-exit ends.

16. The cable exercise device according to claim 11, and comprising a standing platform located adjacent to said force resistance assembly.

17. A cable exercise device, comprising:

a force resistance assembly including a mounting frame, a rotatable axle operatively supported by said mounting frame, a one-way cable spool carried by said axle, and a magnetic braking device operatively connected to said cable spool, and said one-way cable spool being locked to said axle upon rotation of said cable spool in a working force-resistance direction, and freely movable relative to said axle upon rotation of cable spool in an opposite cable-wind-up direction;

an elongated flexible cable attached to said force resistance assembly, and adapted for winding on and unwinding from said cable spool; and a movable exercise implement secured to said flexible cable, and adapted for being employed by a user performing an exercise, and wherein said exercise implement comprises an elongated hollow bar having a cable-entry end and an opposing cable-exit end, and first and second bearings located at respective cable-entry and cable-exit ends.

18. A cable exercise device, comprising:

a force resistance assembly including a mounting frame, a rotatable axle operatively supported by said mounting frame, a one-way cable spool carried by said axle, and a magnetic braking device operatively connected to said cable spool, and said one-way cable spool being locked to said axle upon rotation of said cable spool in a working force-resistance direction, and freely movable relative to said axle upon rotation of cable spool in an opposite cable-wind-up direction;

an elongated flexible cable attached to said force resistance assembly, and adapted for winding on and unwinding from said cable spool; and a movable exercise implement secured to said flexible cable, and adapted for being employed by a user performing an exercise;

a standing platform located adjacent to said force resistance assembly; and means for releasably attaching the free end of said flexible cable to said standing platform.

* * * * *